US007097042B2

(12) United States Patent
Hsu

(10) Patent No.: US 7,097,042 B2
(45) Date of Patent: Aug. 29, 2006

(54) PORTABLE ACCESSORY BOX

(75) Inventor: Feng-Ling Hsu, Pa Te (TW)

(73) Assignee: Quanta Computer, Inc., Taoyuan Hsien (TW)

( * ) Notice: Subject to any disclaimer, the term of this patent is extended or adjusted under 35 U.S.C. 154(b) by 191 days.

(21) Appl. No.: 10/785,626

(22) Filed: Feb. 25, 2004

(65) Prior Publication Data

US 2005/0023161 A1 Feb. 3, 2005

(30) Foreign Application Priority Data

Jul. 31, 2003 (TW) ..... 92121047 A

(51) Int. Cl.
*B65D 79/00* (2006.01)
*B65D 25/04* (2006.01)

(52) U.S. Cl. ..... 206/751; 206/320; 206/305; 206/521; 206/586; 206/45.21; 206/45.23; 206/591; 229/120.04; 229/120.18

(58) Field of Classification Search ..... 206/320, 206/305, 521, 586–8, 591–4, 751–753, 45.2–45.27, 206/756; 229/120.04, 120.18
See application file for complete search history.

(56) References Cited

U.S. PATENT DOCUMENTS 2,271,243 A * 1/1942 Barker ..... 229/120.18
2,284,815 A * 6/1942 Grimm ..... 229/120.04
3,018,940 A * 1/1962 Deline ..... 229/123.2
4,214,696 A * 7/1980 Barton et al. ..... 229/103.3
4,438,848 A * 3/1984 Montealegre et al. ..... 206/588
4,511,079 A * 4/1985 Lopez ..... 229/101
4,522,303 A * 6/1985 Starr ..... 206/588
5,285,956 A * 2/1994 Piepho ..... 229/191
5,586,679 A * 12/1996 Thomas ..... 27/4
5,899,336 A * 5/1999 Kataoka ..... 206/592
6,675,970 B1 * 1/2004 Nemoto ..... 206/521
6,708,874 B1 * 3/2004 Montgomery ..... 229/117.16

* cited by examiner

*Primary Examiner*—Jila M. Mohandesi
*Assistant Examiner*—Steven Pollicoff
(74) *Attorney, Agent, or Firm*—Rabin & Berdo, PC

(57) ABSTRACT

A portable accessory box is disclosed. The portable accessory box comprises: a bottom plate; two side rectangular bodies fixedly connected to two sides of the bottom plate; and a lower side plate fixedly connected to the lower side of the bottom plate. The portable accessory box can further comprise an upper side plate fixedly connected to the upper side of the bottom plate. The bottom plate includes a hand-held hole for carrying and two fixed pieces used to fix the side rectangular bodies. In addition, each of the side rectangular bodies comprises an embedded slot, and the lower side plate and the upper side plate both include an inner side piece. When the lower side plate and the upper side plate are folded inwardly, the inner side pieces can be embedded into the embedded slots of the side rectangular bodies to divide each of the side rectangular bodies into two rectangular sub-bodies and form a lower rectangular body and an upper rectangular body between the side rectangular bodies.

20 Claims, 7 Drawing Sheets

PORTABLE ACCESSORY BOX

FIELD OF THE INVENTION

The present invention relates to a portable accessory box, and more particularly, to a portable accessory box formed by folding a one piece paper material.

BACKGROUND OF THE INVENTION

Electronic products, such as notebooks, have many related accessories. For example, a notebook may have accessories comprising a transformer, a power cord and a mouse. In order to prevent electronic products, such as notebooks, and related accessories thereof from being damaged during transportation, protective packaging structures are generally used to package these electronic products, so as to support and protect the objects disposed in the packaging cartons, thereby avoiding damage due to external impact. Inside the commonly-used packaging cartons, the frequently-used materials forming the protective packaging structures are, for example, plastic, paper, and metal. Of these, paper is quite popularly selected for manufacturing the packaging structures because it is easily processed, has a low technical threshold, is cheap, and can be easily printed on.

In addition, based on the principle of environmental protection, the packaging structures of paper can be produced from reprocessed paper pulp and be recycled. Moreover, unlike other materials, paper materials do not need to bear the cost of recycling. Therefore, the utilization of paper materials can reduce the ecological impact on the environment and is cheap.

Besides, in order to protect accessories of the electronic product from damage caused by collision and from being scattered in packaging carton, currently, the relative popular method is to pack the accessories of the electronic product into an accessory box and then pack the accessory box and the electronic product into the packaging carton together.

An accessory box is typically composed of a box and one or many inner spacers. With the inner spacers, the internal space of the box is separated into a plurality of deposed spaces, so that the accessories of the electronic product can be put into the deposed spaces of the accessory box, and a benefit of arrangement is obtained, thus avoiding damage caused by collision.

SUMMARY OF THE INVENTION

An objective of the present invention is to provide a portable accessory box formed by folding a paper material, and the portable accessory box can be made in one piece. Therefore, the portable accessory box is formed easily and production cost is reduced.

Another objective of the present invention is to provide a portable accessory box formed of a paper material, thus reducing the environmental burden thereof and meeting the requirement of environmental protection.

Still another objective of the present invention is to provide a portable accessory box, which is one piece and can replace an old type portable accessory box composed of an outer box and inner spacers. Therefore, complicated operation in transportation, control of materiel and supplies, and fabrication manpower in the production line can be left out.

Further another objective of the present invention is to provide a portable accessory box, which can be used to contain accessories of an electronic product, such as a notebook. The portable accessory box of the present invention comprises a hand-held hole or a hand-taken hole; therefore the portable accessory box can be taken out easily with the hand-held hole or the hand-taken hole while the portable accessory box is taken out from the packaging carton of the electronic product.

According to the aforementioned objectives of the present invention, the present invention provides a portable accessory box comprising: a bottom plate, wherein the bottom plate comprises a hand-held hole; two side rectangular bodies fixedly connected to two sides of the bottom plate, wherein each side rectangular body comprises an embedded slot; and a lower side plate fixedly connected to the lower side of the bottom plate, wherein the lower side plate comprises a fixed piece, and the lower side plate is folded upwardly and inwardly to make the fixed piece embed into the embedded slot of each side rectangular body, so as to divide each side rectangular body into two rectangular sub-bodies and form a lower rectangular body between the side rectangular bodies.

According to a preferred embodiment of the present invention, the bottom plate further comprises two fixed pieces, and each side rectangular body comprises at least one insertion slot. By inserting the fixed pieces of the bottom plate into the insertion slot of each side rectangular body, the side rectangular bodies can be fixed.

According to the aforementioned objectives of the present invention, the present invention provides a portable accessory box comprising: a bottom plate; two side rectangular bodies fixedly connected to two sides of the bottom plate, wherein each side rectangular body comprises an embedded slot; a lower side plate fixedly connected to the lower side of the bottom plate, wherein the lower side plate comprises an inner side piece, and the lower side plate is folded upwardly and inwardly to make the inner piece of the lower side plate embed into the embedded slot of each side rectangular body, so as to divide each side rectangular body into two rectangular sub-bodies and form a lower rectangular body between the side rectangular bodies; and an upper side plate fixedly connected to the upper side of the bottom plate. The upper side plate comprises: an inner side piece, wherein the upper side plate is folded downwardly and inwardly to make the inner side piece embed into the embedded slot of each side rectangular body, so as to form an upper rectangular body between the side rectangular bodies; and an outer side piece, wherein the outer side piece comprises two hand-taken holes for carrying the portable accessory box.

According to a preferred embodiment of the present invention, each side rectangular body further comprises an insertion slot, and the bottom plate comprises two fixed pieces. By inserting the fixed pieces of the bottom plate into the insertion slot of each side rectangular body, the side rectangular bodies can be fixed.

The portable accessory box of the present invention is formed by folding a paper material and is one piece, so it is quite easy to fabricate the portable accessory box, production cost is reduced and the environmental burden thereof is reduced to meet the requirement of environmental protection. In addition, the portable accessory box of the present invention includes a hand-held hole or hand-taken hole, so the portable accessory box can be taken out from the packaging carton of the electronic product easily. Therefore, it is very convenient.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention discloses a portable accessory box formed by folding a paper material, and the portable accessory box can be formed in one piece. Therefore, the portable accessory box is easily fabricated, the cost thereof can be reduced, and manpower expended in the manufacture thereof can be saved. In order to make the illustration of the present invention more explicit and complete, the following description is given in conjunction with the drawings from FIG. 1 to FIG. 7.

Figure 1:
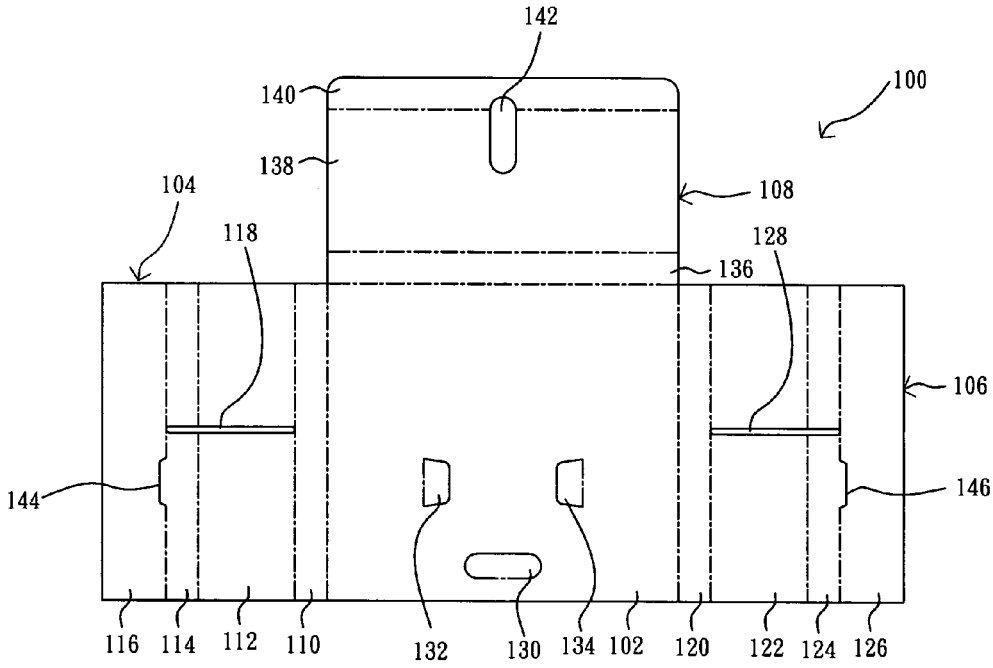
FIG. 1 is a diagram showing an unfolded portable accessory box in accordance with a preferred embodiment of the present invention.

Referring to FIG. 1, FIG. 1 is a diagram showing an unfolded portable accessory box in accordance with a preferred embodiment of the present invention. A material of a portable accessory box 100 is preferably a paper material having a buffer structure, such as corrugated paper. The portable accessory box 100 comprises a bottom plate 102, a side plate 104 and a side plate 106 fixedly connected to two sides of the bottom plate 102, respectively, and a lower side plate 108 fixedly connected to the lower side of the bottom plate 102.

The side plate 104 comprises an outer side piece 110, an upper side piece 112, an inner side piece 114 and a lower side piece 116 connected in sequence, wherein the outer side piece 110 is connected with the bottom plate 102. The side plate 104 further comprises an embedded slot 118 and an insertion slot 144, wherein the embedded slot 118 is in the inner side piece 114 and the upper side piece 112, and the insertion slot 144 is located between the inner side piece 114 and the lower side piece 116.

Similarly, the side plate 106 comprises an outer side piece 120, an upper side piece 122, an inner side piece 124 and a lower side piece 126 connected in sequence, wherein the outer side piece 120 is connected with the bottom plate 102. The side plate 106 further comprises an embedded slot 128 and an insertion slot 146, wherein the embedded slot 128 is in the inner side piece 124 and the upper side piece 122, and the insertion slot 146 is located between the inner side piece 124 and the lower side piece 126. The lower side plate 108 comprises an outer side piece 136, an upper side piece 138 and an inner side piece 140 connected in sequence, wherein the outer side piece 136 is connected with the bottom plate 102. The lower side plate 108 further comprises an opening hole 142 located in the inner side piece 140 and the upper side piece 138, and the opening hole 142 also can be directly located on the upper side piece 138.

The bottom plate 102 comprises a hand-held hole 130, as well as a fixed piece 132 and a fixed piece 134 respectively located at the two sides of the hand-held hole 130. The hand-held hole 130 is used to carry the portable accessory box 100; and the locations of the fixed piece 132 and the fixed piece 134 correspond to the locations of the insertion slot 144 and the insertion slot 146, respectively. The fixed piece 132 and the fixed piece 134 can be inserted into the insertion slot 144 and the insertion slot 146, respectively.

Figure 2:
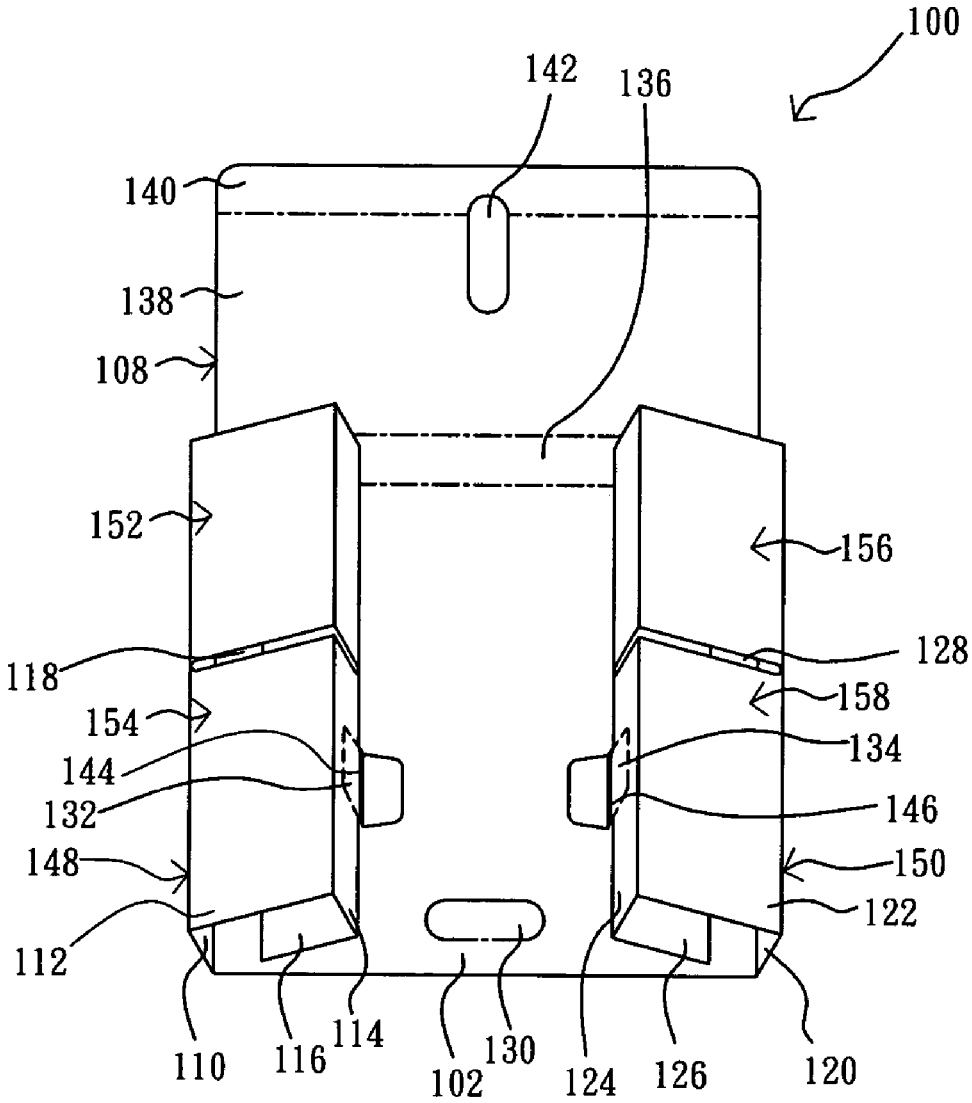
FIG. 2 to FIG. 3 are assembly diagrams showing a portable accessory box in accordance with a preferred embodiment of the present invention.
Figure 3:
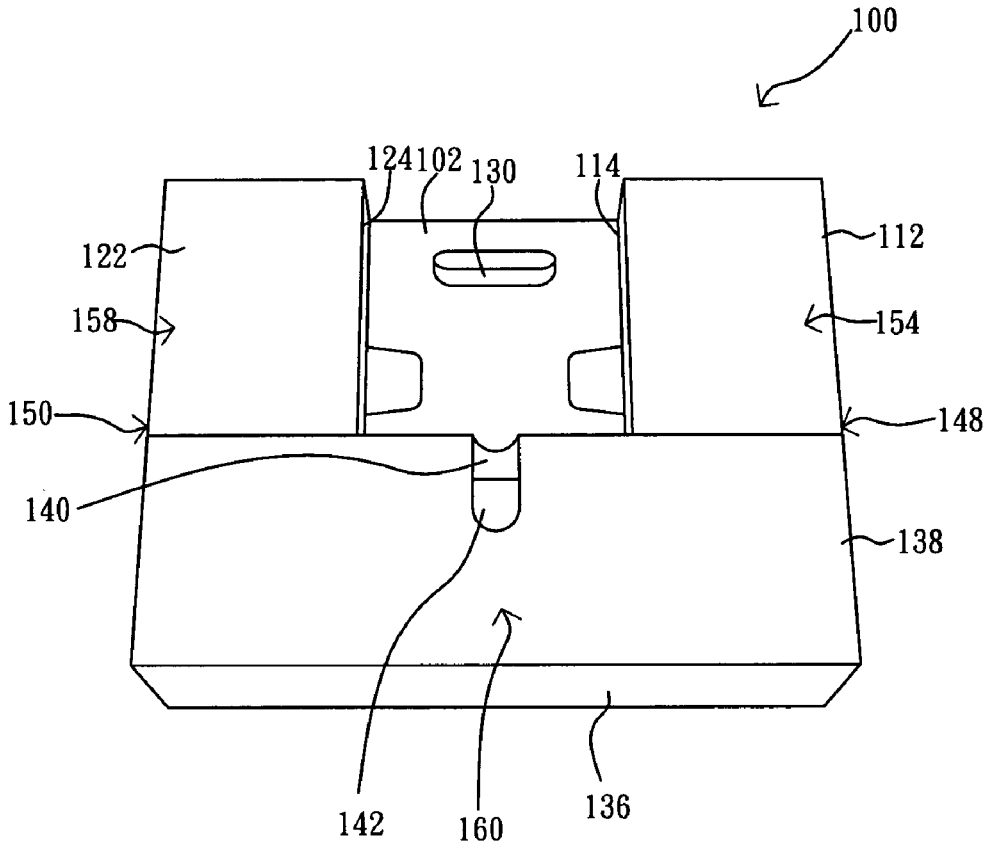

Referring to FIG. 2 to FIG. 3, FIG. 2 to FIG. 3 are assembly diagrams showing a portable accessory box in accordance with a preferred embodiment of the present invention, with simultaneous reference to FIG. 1. The portable accessory box 100 is assembled by first folding the side plate 104 and the side plate 106, and then folding the lower side plate 108. The side plate 104 is folded toward the interior of the bottom plate 102 along the folding lines between the side pieces of the side plate 104 to form a side rectangular body 148. The embedded slot 118 is in the upper side and the inner side of the side rectangular body 148. When the side plate 104 is folded inwardly, the fixed piece 132 of the bottom plate 102 can be inserted into the insertion slot 144 between the inner side piece 114 and the lower side piece 116 to fix the side rectangular body 148.

After the side rectangular body 148 is formed, the side plate 106 is folded inwardly by the same method to form a side rectangular body 150. The embedded slot 128 is in the upper side and the inner side of the side rectangular body 150. When the side plate 106 is folded inwardly, the fixed piece 134 of the bottom plate 102 can be inserted into the insertion slot 146 between the inner side piece 124 and the lower side piece 126 to fix the side rectangular body 150. After the side plate 104 and the side plate 106 are folded, the side rectangular body 148 and the side rectangular body 150 are formed at the two sides of the bottom plate 102, respectively, as illustrated in FIG. 2. The sequence of folding the side rectangular body 148 and the side rectangular body 150 can be changed to fold the side rectangular body 150 first and then fold the side rectangular body 148, and the sequence of folding the side rectangular body 148 and the side rectangular body 150 is not limited in the present invention.

After the side rectangular body 148 and the side rectangular body 150 are formed, the lower side plate 108 is folded toward the interior of the bottom plate 102 along the folding lines between the side pieces of the lower side plate 108 to insert the inner side piece 140 of the lower side plate 108 into the embedded slot 118 of the side rectangular body 148 and the embedded slot 128 of the side rectangular body 150. The side rectangular body 148 is thus separated into a rectangular sub-body 152 and a rectangular sub-body 154. The side rectangular body 150 is separated into a rectangular sub-body 156 and a rectangular sub-body 158. A lower rectangular body 160 is formed between the side rectangular body 148 and the side rectangular body 150, as illustrated in FIG. 3. After the lower rectangular body 160 is formed, the opening hole 142 is located in the upper side of the lower rectangular body 160. The opening hole 142 not only has a benefit for opening the lower rectangular body 160 conveniently, but also provides a window for viewing the objects deposed therein when the lower rectangular body 160 is closed.

In the embodiment, the portable accessory box 100 is formed by folding a paper material and is one piece, and the portable accessory box 100 provides five independent sections, i.e. the rectangular sub-body 152, the rectangular sub-body 154, the rectangular sub-body 156, the rectangular sub-body 158 and the lower rectangular body 160, for storing accessories of a product. Moreover, the portable accessory box 100 further comprises a hand-held hole 130. Since the portable accessory box 100 is typically packed in the same packaging carton, such as a packaging carton of a notebook, with the product, the hand-held hole 130 is convenient for carrying the portable accessory box 100.

Figure 4:
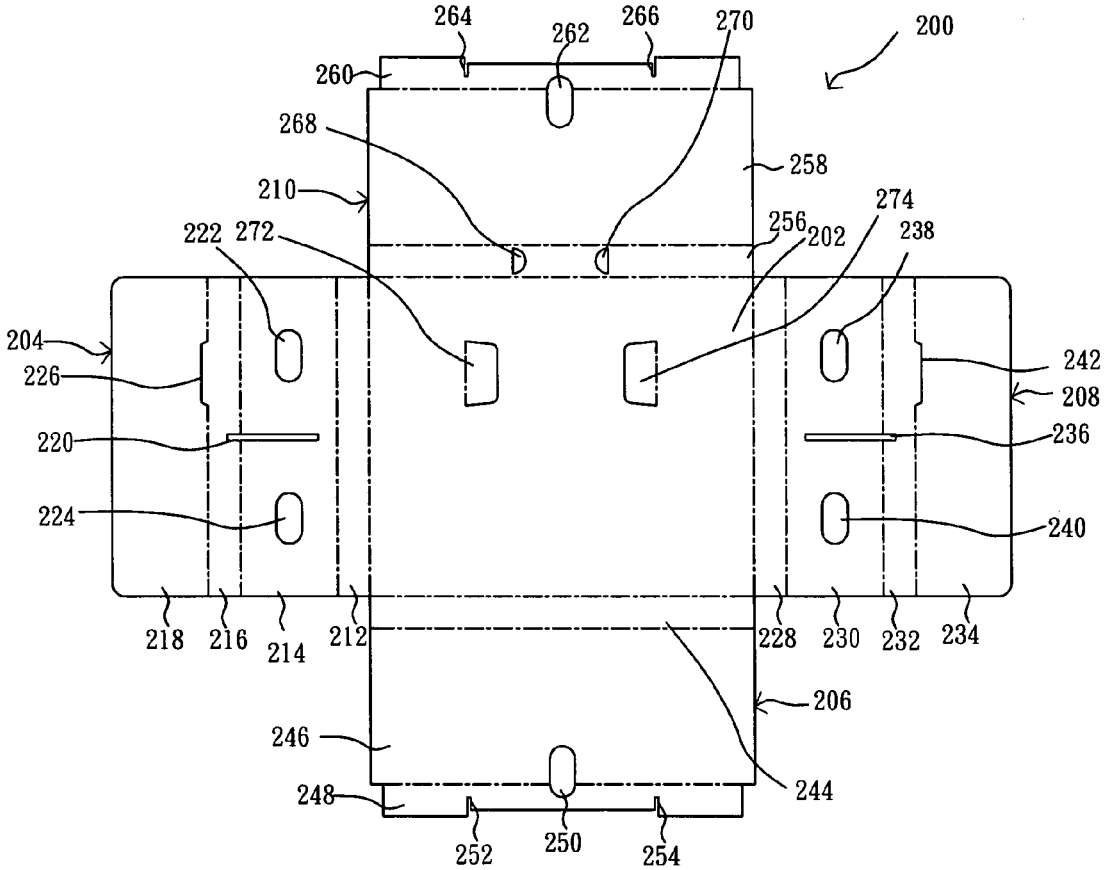
FIG. 4 is a diagram showing an unfolded portable accessory box in accordance with another preferred embodiment of the present invention.

Referring to FIG. 4, FIG. 4 is a diagram showing an unfolded portable accessory box in accordance with another preferred embodiment of the present invention. A material of a portable accessory box 200 is preferably selected from a paper material having a buffer structure, such as corrugated paper. The portable accessory box 200 comprises a bottom plate 202, a side plate 204 and a side plate 208 fixedly connected to two sides of the bottom plate 202 respectively, a upper side plate 210 fixedly connected to the upper side of the bottom plate 202, and a lower side plate 206 fixedly connected to the lower side of the bottom plate 202.

The side plate 204 comprises an outer side piece 212, an upper side piece 214, an inner side piece 216 and a lower side piece 218 connected in sequence, wherein the outer side piece 212 is connected with the bottom plate 202. The side plate 204 further comprises an embedded slot 220, an insertion slot 226, and hole 222 and hole 224. The embedded slot 220 is in the inner side piece 216 and the upper side piece 214. The insertion slot 226 is located between the inner side piece 216 and the lower side piece 218. The hole 222 and the hole 224 are located in the upper side piece 214 and at two sides of the embedded slot 220, respectively. Similarly, the side plate 208 comprises an outer side piece 228, an upper side piece 230, an inner side piece 232 and a lower side piece 234 connected in sequence. The outer side piece 228 is connected with the bottom plate 202. The side plate 208 further comprises an embedded slot 236, an insertion slot 242, and hole 238 and hole 240. The embedded slot 236 is in the inner side piece 232 and the upper side piece 230; the insertion slot 242 is located between the inner side piece 232 and the lower side piece 234; and the hole 238 and the hole 240 are located on the upper side piece 230 and at two sides of the embedded slot 236, respectively.

The lower side plate 206 comprises an outer side piece 244, an upper side piece 246 and an inner side piece 248 connected in sequence, wherein the outer side piece 244 is connected with the bottom plate 202. The lower side plate 206 further comprises an opening hole 250, and a lower embedded slot 252 and a lower embedded slot 254. The opening hole 250 is located in the inner side piece 248 and the upper side piece 246, and the opening hole 250 also can be directly located in the upper side piece 246. The lower embedded slot 252 and the lower embedded slot 254 are located in the inner side piece 248 and at two sides of the opening hole 250, respectively. The upper side plate 210 comprises an outer side piece 256, an upper side piece 258 and an inner side piece 260 connected in sequence, wherein the outer side piece 256 is connected with the bottom plate 202. The upper side plate 210 further comprises an opening hole 262, a hand-taken hole 268 and a hand-taken hole 270, and a lower embedded slot 264 and a lower embedded slot 266. The opening hole 262 is located in the inner side piece 260 and the upper side piece 258, and the opening hole 262 also can be directly located in the upper side piece 258. The lower embedded slot 264 and the lower embedded slot 266 are located in the inner side piece 260 and at two sides of the opening hole 262, respectively, and the hand-taken hole 268 and the hand-taken hole 270 are located in the outer side piece 256 and separated by a distance. The hand-taken hole 268 and the hand-taken hole 270 are provided for carrying the portable accessory box 200.

The bottom plate 202 comprises a fixed piece 272 and a fixed piece 274. The locations of the fixed piece 272 and the fixed piece 274 correspond to the locations of the insertion slot 226 and the insertion slot 242, respectively, and the fixed piece 272 and the fixed piece 274 can be inserted into the insertion slot 226 and the insertion slot 242, respectively.

Figure 5:
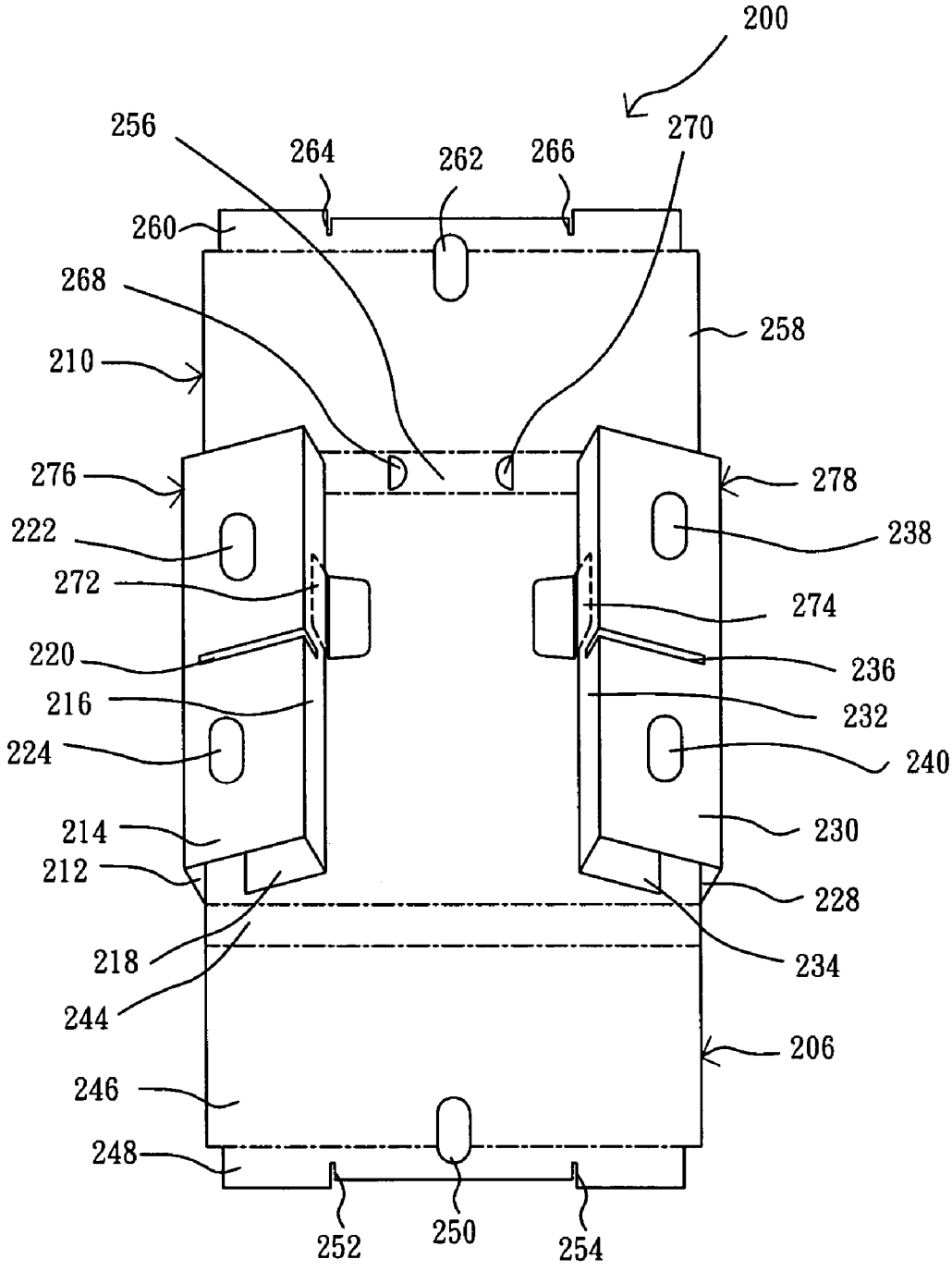
FIG. 5 to FIG. 7 are assembly diagrams showing a portable accessory box in accordance with another preferred embodiment of the present invention.
Figure 6:
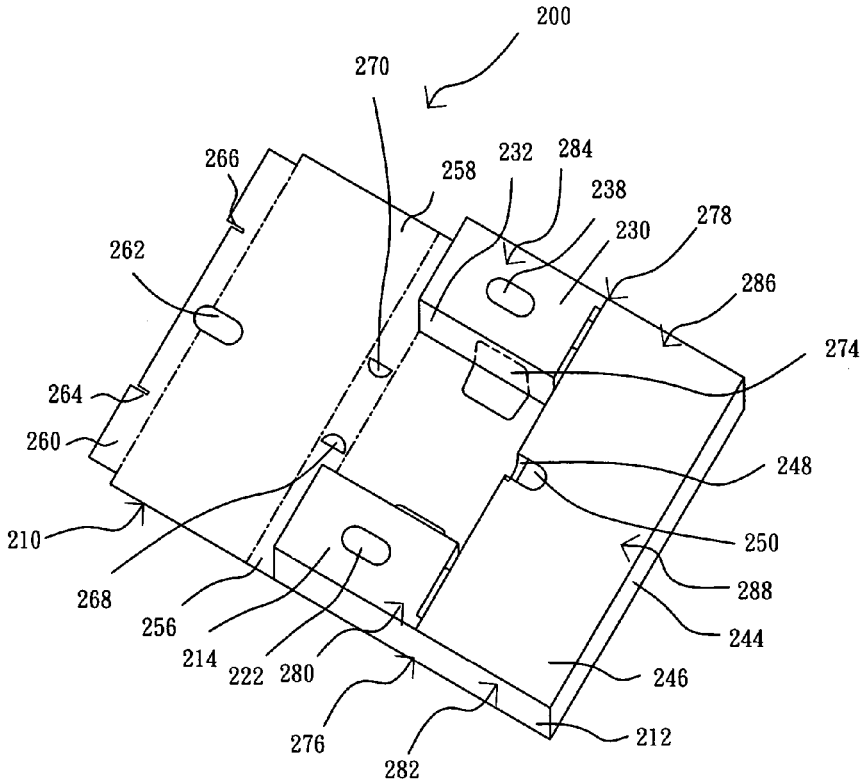
Figure 7:
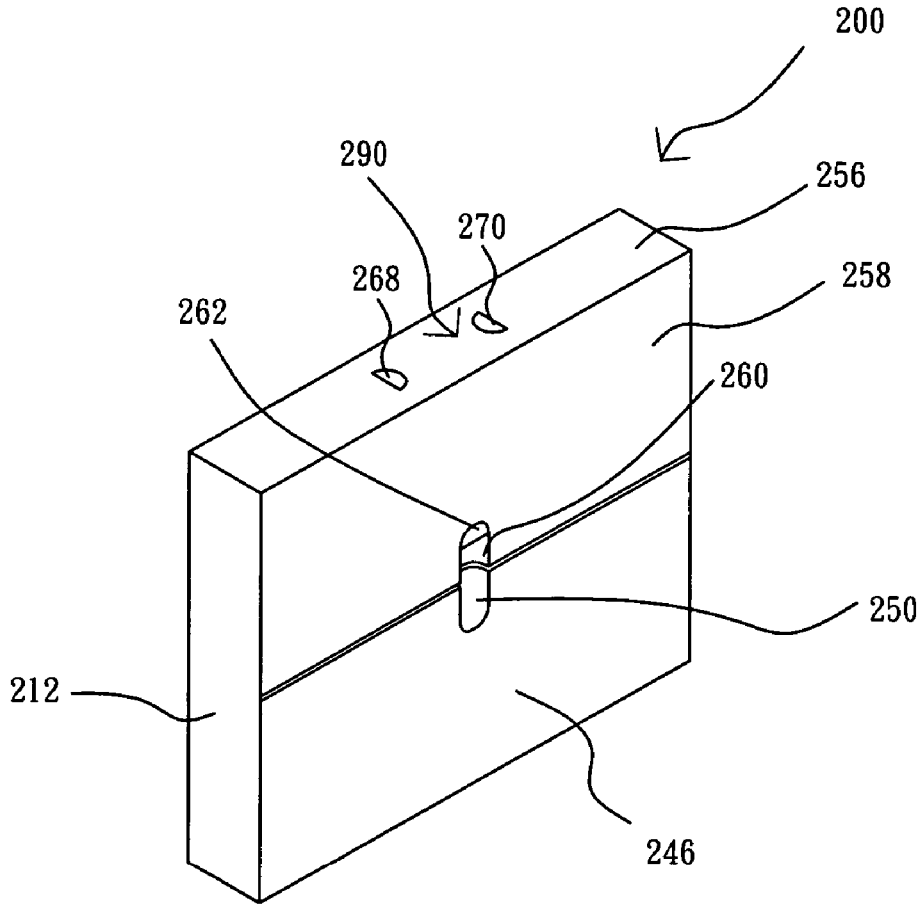

Referring to FIG. 5 to FIG. 7, FIG. 5 to FIG. 7 are assembly diagrams showing a portable accessory box in accordance with another preferred embodiment of the present invention, with simultaneous reference to FIG. 4. The assembly of the portable accessory box 200 is to fold the side plate 204 and the side plate 208 first, and then to fold the lower side plate 206 and the upper side plate 210. The side plate 204 is folded toward the interior of the bottom plate 202 along the folding lines between the side pieces of the side plate 204 to form a side rectangular body 276. The embedded slot 220 is in the upper side and the inner side of the side rectangular body 276, and the hole 222 and the hole 224 are located in the upper side of the side rectangular body 276. When the side plate 204 is folded inwardly, the fixed piece 272 of the bottom plate 202 can be inserted into the insertion slot 226 between the inner side piece 216 and the lower side piece 218 to fix the side rectangular body 276. The hole 222 and the hole 224 provide windows for viewing objects stored therein when the side rectangular body 276 is closed.

After the side rectangular body 276 is formed, the side plate 208 is folded inwardly by the same method to form a side rectangular body 278. The embedded slot 236 is in the upper side and a portion of the inner side of the side rectangular body 278, and the hole 238 and the hole 240 are located in the upper side of the side rectangular body 278. When the side plate 208 is folded inwardly, the fixed piece 274 of the bottom plate 202 can be inserted into the insertion slot 242 between the inner side piece 232 and the lower side piece 234 to fix the side rectangular body 278. After the side plate 204 and the side plate 208 are folded, the side rectangular body 276 and the side rectangular body 278 are formed at the two sides of the bottom plate 202, respectively, such as shown in FIG. 5. The sequence of folding the side rectangular body 276 and the side rectangular body 278 is not limited to the above description, and the side rectangular body 278 can be folded first, and then the side rectangular body 276 is folded. The hole 238 and the hole 240 provide windows for viewing the objects stored therein when the side rectangular body 278 is closed.

After the side rectangular body 276 and the side rectangular body 278 are formed, the lower side plate 206 is folded toward the interior of the bottom plate 202 along the folding lines between the side pieces of the lower side plate 206 to insert the inner side piece 248 of the lower side plate 206 into the embedded slot 220 of the side rectangular body 276 and the embedded slot 236 of the side rectangular body 278, and to inset the lower embedded slot 252 and the lower embedded slot 254 of the inner side piece 248 of the lower side plate 206 into the embedded slot 220 and the embedded slot 236, respectively. The inner side piece 248 embedded into the embedded slot 220 and the embedded slot 236 separates the side rectangular body 276 into a rectangular sub-body 280 and a rectangular sub-body 282 and separates the side rectangular body 278 into a rectangular sub-body 284 and a rectangular sub-body 286, as well as forms a lower rectangular body 288 between the side rectangular body 276 and the side rectangular body 278, as illustrated in FIG. 6. After the lower rectangular body 288 is formed, the opening hole 250 is located in the upper side of the lower rectangular body 288. The opening hole 250 not only allows convenient opening of the lower rectangular body 288, but also provides a window for viewing the objects stored therein when the lower rectangular body 288 is closed.

After the lower rectangular body 288 is formed, the upper side plate 210 is folded toward the interior of the bottom plate 202 along the folding lines between the side pieces of the upper side plate 210 to insert the inner side piece 260 of the upper side plate 210 into the embedded slot 220 of the side rectangular body 276 and the embedded slot 236 of the side rectangular body 278, and to insert the lower embedded slot 264 and the lower embedded slot 266 of the inner side piece 260 of the upper side plate 210 into the embedded slot 220 and the embedded slot 236, respectively. An upper rectangular body 290 is formed between the side rectangular body 276 and the side rectangular body 278, such as shown in FIG. 7. After the upper rectangular body 290 is formed, the opening hole 262 is located in the upper side of the upper rectangular body 290. The opening hole 262 not only allows convenient opening of the upper rectangular body 290, but also provides a window for viewing the objects stored therein when lower rectangular body 290 is closed.

In the embodiment, the portable accessory box 200 is formed by folding a paper material and is one piece, and the portable accessory box 200 provides six independent sections, i.e. the rectangular sub-body 280, the rectangular sub-body 282, the rectangular sub-body 284, the rectangular sub-body 286, the lower rectangular body 288 and the upper rectangular body 290, for storing accessories of a product. Moreover, the portable accessory box 200 further comprises a hand-taken hole 268 and a hand-taken hole 270. Since the portable accessory box 200 is typically packed in the same packaging carton, such as a packaging carton of a notebook, with the product, the hand-taken hole 268 and the hand-taken hole 270 are convenient for carrying the portable accessory box 200.

In a preferred embodiment of the present invention, the portable accessory box of the present invention can sustain an impact of about 50 G in a drop test when the portable accessory box falls from a height of 107 centimeters while containing accessories having a weight of 4 kilograms.

According to the aforementioned description, one advantage of the present invention is that the portable accessory box of the present invention is formed by folding a paper material and is made in one piece. Therefore, the portable accessory box is formed easily, thereby reducing production cost.

According to the aforementioned description, another advantage of the present invention is that a material of the portable accessory box of the present invention is paper, and thus reducing the environmental burden thereof and meeting the requirement of environmental protection.

According to the aforementioned description, still another advantage of the present invention is that the portable accessory box of the present invention is made in one piece and can replace the conventional portable accessory box composed of an outer box and inner spacers. Therefore, complicated operation in transportation, control of materiel and supplies, and fabrication manpower in the production line can be left out.

According to the aforementioned description, a further another advantage of the present invention is that the portable accessory box of the present invention comprises a hand-held hole or a hand-taken hole, and therefore is conveniently carried.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structure.

What is claimed is:

1. A portable accessory box, comprising:

a bottom plate, wherein the bottom plate comprises a hand-held hole;

two side rectangular bodies fixedly connected to two sides of the bottom plate, wherein each of the side rectangular bodies comprises an embedded slot, and the side rectangular bodies are spaced; and a lower side plate fixedly connected to a lower side of the bottom plate, wherein the lower side plate comprises an inner side piece, and the lower side plate is folded upwardly and inwardly to embed the inner side piece into the embedded slot of each of the side rectangular bodies, so as to divide each of the side rectangular bodies into two rectangular sub-bodies and form a lower rectangular body between the side rectangular bodies, and to provide five independent sections including the rectangular sub-bodies of each side rectangular body and the lower rectangular body for storing accessories.

2. The portable accessory box according to claim 1, wherein the bottom plate further comprises two fixed pieces, each of the side rectangular bodies comprises an insertion slot, and the fixed pieces of the bottom plate are inserted into the insertion slot of each of the side rectangular bodies respectively to fix the side rectangular bodies.

3. The portable accessory box according to claim 2, wherein each of the side rectangular bodies comprises an outer side piece, an upper side piece, an inner side piece and a lower side piece connected in sequence, and the insertion slot of each of the side rectangular bodies is located between the inner side piece and the lower side piece.

4. The portable accessory box according to claim 1, wherein the lower side plate comprises an outer side piece, an upper side piece and the inner side piece connected in sequence, and the lower side plate further comprises an opening hole located in the upper side piece for a benefit of opening the lower rectangular body.

5. The portable accessory box according to claim 1, wherein the portable accessory box is disposed in a packaging carton of a notebook.

6. The portable accessory box according to claim 1, wherein a material of the portable accessory box is a paper plate having a buffer structure.

7. A portable accessory box, comprising:

a bottom plate, wherein the bottom plate comprises two fixed pieces and a hand-held hole;

two side plates fixedly connected to two sides of the bottom plate, respectively, wherein each of the side plates is folded inwardly to form a side rectangular body, each of the side rectangular bodies comprises an insertion slot and an embedded slot, and the fixed pieces of the bottom plate are inserted into the insertion slots of the side rectangular bodies made from the side plates to fix the side rectangular bodies, and the side rectangular bodies are spaced; and a lower side plate fixedly connected to a lower side of the bottom plate, wherein the lower side plate comprises an inner side piece, and the lower side plate is folded upwardly and inwardly to embed the inner side piece into the embedded slots of the side rectangular bodies made from the side plates, so as to divide each of the side rectangular bodies into two rectangular sub-bodies and form a lower rectangular body between the side rectangular bodies, and to provide five independent sections including the rectangular sub-bodies of each side rectangular body and lower rectangular body for storing accessories.

8. The portable accessory box according to claim 7, wherein each of the side rectangular bodies comprises an outer side piece, an upper side piece, an inner side piece and a lower side piece connected in sequence, and the insertion slot of each of the side rectangular bodies is located between the inner side piece and the lower side piece.

9. The portable accessory box according to claim 7, wherein the lower side plate comprises an outer side piece, an upper side piece and the inner side piece connected in sequence, and the lower side plate further comprises an opening hole located in the upper side piece for a benefit of opening the lower rectangular body.

10. The portable accessory box according to claim 7, wherein the portable accessory box is disposed in a packaging carton of a notebook.

11. The portable accessory box according to claim 7, wherein a material of the portable accessory box is a paper plate having a buffer structure.

12. The portable accessory box according to claim 7, wherein a material of the portable accessory box is corrugated paper.

13. A portable accessory box, comprising:

a bottom plate;

two side rectangular bodies fixedly connected to two sides of the bottom plate, wherein each of the side rectangular bodies comprises an embedded slot, and the side rectangular bodies are spaced;

a lower side plate fixedly connected to a lower side of the bottom plate, wherein the lower side plate comprises an inner side piece, and the lower side plate is folded upwardly and inwardly to embed the inner side piece of the lower side plate into the embedded slot of each of the side rectangular bodies, so as to divide each of the side rectangular bodies into two rectangular sub-bodies and form a lower rectangular body between the side rectangular bodies; and an upper side plate fixedly connected to an upper side of the bottom plate, wherein the upper side plate comprises:

an inner side piece, wherein the upper side plate is folded downwardly and inwardly to embed the inner side piece into the embedded slot of each of the side rectangular bodies, so as to form an upper rectangular body between the side rectangular bodies, and six independent sections including the rectangular sub-bodies of each side rectangular body, the lower rectangular body and the upper rectangular body are provided for storing accessories; and an outer side piece, wherein the outer side piece comprises a hand-taken hole for carrying the portable accessory box.

14. The portable accessory box according to claim 13, wherein each of the side rectangular bodies comprises an outer side piece, an upper side piece, an inner side piece and a lower side piece connected in sequence.

15. The portable accessory box according to claim 14, wherein each of the side rectangular bodies comprises an insertion slot located between the inner side piece and the lower side piece.

16. The portable accessory box according to claim 15, wherein the bottom plate comprises two fixed pieces inserted into the insertion slot of each of the side rectangular bodies, respectively, to fix the side rectangular bodies.

17. The portable accessory box according to claim 13, wherein the lower side plate comprises an outer side piece, an upper side piece and the inner side piece connected in sequence.

18. The portable accessory box according to claim 17, wherein the lower side plate further comprises two lower embedded slots located in the inner side piece for the inner side piece of the lower side plate to embed into the embedded slot of each of the side rectangular bodies.

19. The portable accessory box according to claim 13, wherein the upper side plate further comprises an upper side piece connected between the inner side piece of the upper side plate and the outer side piece of the upper side plate.

20. The portable accessory box according to claim 19, wherein the upper side plate further comprises two lower embedded slots located in the inner side piece for the inner side piece of the upper side plate to embed into the embedded slot of each of the side rectangular bodies.

* * * * *